United States Patent [19]

Takami et al.

[11] 3,936,302

[45] Feb. 3, 1976

[54] METHOD FOR MANUFACTURING FLUORESCENT SCREENS FOR USE IN COLOUR PICTURE TUBES

[75] Inventors: Yasuji Takami; Kenji Fukuda, both of Mobara; Eiichi Yamazaki, Ichihara, all of Japan

[73] Assignee: Hitachi, Ltd., Tokyo, Japan

[22] Filed: Feb. 7, 1973

[21] Appl. No.: 330,233

[30] Foreign Application Priority Data

Feb. 7, 1972 Japan ..... 47-12874

[52] U.S. Cl. ..... 96/36.1; 96/27 E; 313/474; 427/68

[51] Int. Cl.² ..... G03C 5/00

[58] Field of Search ..... 117/33.5 C, 33.5 CM; 96/36.1, 27 E; 313/474; 427/68

[56] References Cited

UNITED STATES PATENTS

| | | | |
|---|---|---|---|
| 3,367,790 | 2/1968 | Saulnier | 117/33.5 CM |
| 3,440,080 | 4/1969 | Tamura et al. | 313/92 |
| 3,598,628 | 8/1971 | Goodman | 117/33.5 CM |
| 3,652,895 | 3/1972 | Tsuneta et al. | 96/36.1 |
| 3,653,900 | 4/1972 | Black | 96/36.1 |
| 3,666,462 | 5/1972 | Kaplan | 96/36.1 |
| 3,725,106 | 4/1973 | Hosokoshi | 117/33.5 CM |
| 3,764,366 | 10/1973 | Ninagawa et al. | 117/33.5 CM |
| 3,779,760 | 12/1973 | Miyaoka | 117/33.5 CM |

*Primary Examiner*—Harry J. Gwinnell
*Attorney, Agent, or Firm*—Charles E. Pfund, Esq.

[57] ABSTRACT

A fluorescent screen including a plurality of parallel stripes of three colour phosphors is prepared by projecting light from a linear light source positioned in parallel with the stripes on photosensitive substances coated on the inner surface of the panel through a plurality of stripe shaped perforations of a colour selecting member, each divided into a plurality of slit shaped sections by means of bridges. The linear light source is constituted by reciprocating a point light source in parallel with the stripe shaped perforations.

3 Claims, 7 Drawing Figures

METHOD FOR MANUFACTURING FLUORESCENT SCREENS FOR USE IN COLOUR PICTURE TUBES

BACKGROUND OF THE INVENTION

This invention relates to a method of manufacturing a colour picture tube and more particularly to a method of exposing the photosensitive substances coated on the panel of the tube for preparing a fluorescent screen including a plurality of continuous stripe shaped three colour phosphors. The exposure light is projected through a plurality of parallel stripe shaped perforations of a colour selecting member or electrode (hereinafter called a colour selecting member), the perforations extending in one direction of deflection of the electron beam, and each one of said stripe shaped perforations being divided into a plurality of slit shaped sections by bridges extending in a direction perpendicular to the longitudinal direction of the perforation.

As is well known in the art the fluorescent screen of a colour picture tube is prepared by regularly coating photosensitive substances on the inner surface of the face plate and then exposing the photosensitive substances to light by using an exposure device 1 as diagrammatically shown in FIG. 1. The exposure device shown in FIG. 1 comprises a source of point light 2 and a correcting lens 3 for causing the light emanated from the source 2 to approximate the actual locus of the electron beam of a completed colour picture tube. A colour selecting member 4, typically a perforated shadow mask, and a panel 5 supporting the colour selecting member 4 are mounted on the exposure device 1. Photosensitive substances are coated on the inner surface of the panel 5 and exposed to the light emanated from the source of point light 2 and transmitting through the colour selecting member 4 and correcting lens 3 to form a fluorescent screen of a predetermined pattern.

With a widespread use of colour television receivers in recent years, various types of colour picture tubes have been developed. In one type, a colour selecting member provided with a plurality of parallel stripe shaped perforations is used. With this type of the colour selecting member, because it is not necessary to adjust the electron gun assembly in the longitudinal direction of the stripe shaped perforations it is possible to obtain reproduced pictures of higher colour purity with more simple electronic circuit than the well known shadow mask type colour picture tube.

However, since the stripe shaped perforations are formed to cover substantially the full width of the colour selecting member its mechanical strength is small so that it tends to vibrate due to mechanical shocks or large volume sound from a speaker incorporated in a colour television receiver during the use thereof, thereby causing undesirable colour shading. To obviate this difficulty, the stripe shaped perforations are divided into a plurality of slit shaped sections by providing suitably spaced apart bridges extending in a direction perpendicular to the longitudinal direction of the perforations. Such bridges function to reinforce the colour selecting member. However, these bridges intercept the light utilized to expose the photosensitive substances so that resulting stripe shaped three colour phosphors are interrupted at portions corresponding to the bridges.

SUMMARY OF THE INVENTION

Accordingly, it is an object of this invention to provide a method of manufacturing a colour picture tube having an excellent colour purity and free from colour shading.

Another object of this invention is to provide an improved method of preparing a fluorescent screen having continuous stripe shaped trios of three colour phosphors.

Still another object of this invention is to provide a method of preparing a fluorescent screen having continuous stripe shaped trios of three colour phosphors by utilizing a linear source of exposure light.

Yet another object of this invention is to provide a novel method of manufacturing a fluorescent screen having continuous stripe shaped trios of three colours by reciprocating a source of point light.

A further object of this invention is to provide a simple apparatus for manufacturing a fluorescent screen having a plurality of continuous stripe shaped three colour phosphors by using a colour selecting member having a plurality of parallel stripe shaped perforations each divided into a plurality of slit shaped sections by means of bridges.

In accordance with this invention these and other objects can be accomplished by providing a method of manufacturing a fluorescent screen for use in a colour picture tube wherein photosensitive substances coated on the inner surface of the panel of the tube are exposed to light emanated from a source of light through a plurality of parallel stripe shaped perforations of a colour selecting member thereby forming a fluorescent screen including a plurality of parallel stripes of three colour phosphors, said perforations extending over substantially the entire length of one side of said colour selecting member, characterized in that respective stripe shaped perforations are divided into a plurality of slit shaped sections by means of bridges extending at substantially right angles with respect to the longitudinal direction of said perforations, that the exposure light emanated from a linear light source is projected upon said photosensitive substances through said divided slit shaped sections, and that said linear light source is positioned parallel with said perforations.

According to another aspect of this invention, there is provided apparatus for forming a fluorescent screen of a colour picture tube wherein light from a point light source is projected upon photosensitive substances coated on the inner surface of the panel of the tube through a plurality of stripe shaped perforations of a colour selecting member thereby forming a fluorescent screen including a plurality of parallel stripes of three colour phosphors, said perforations extending over substantially the entire length of one side of said colour selecting member, characterized in that there is provided means for reciprocating said point light source in a direction parallel to said stripe shaped perforations.

PREFERRED EMBODIMENTS OF THE INVENTION

According to this invention, a fluorescent screen is prepared including continuous stripe shaped trios of three colour phosphors and utilized for a colour picture tube having a colour selecting member provided with a plurality of parallel stripe shaped perforations extending in one direction of deflecting the electron beam, each stripe shaped perforation being divided into slit shaped sections by means of bridges extending in a direction perpendicular to the perforation.

Figure 2A:
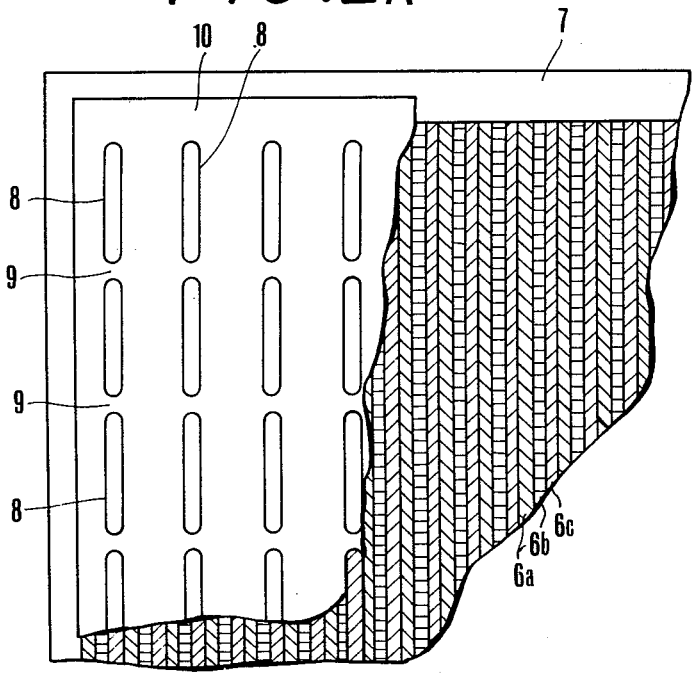
FIG. 2A shows a portion of the fluorescent screen prepared by the method of this invention and a colour selecting member and viewed from the side of the electron gun assembly.

FIG. 2A shows one example of a fluorescent screen manufactured by the method of this invention and a colour selecting member cooperating therewith of a colour picture tube. The fluorescent screen 7 comprises a plurality of regularly arranged continuous stripe shaped trios of three colour phosphors 6a, 6b and 6c extending to cover the full width (in the direction of vertical deflection, for example, of the electron beams) of the colour selecting member. The sets of vertical stripes of three colour phosphors are formed continuously in the horizontal direction.

Figure 1:
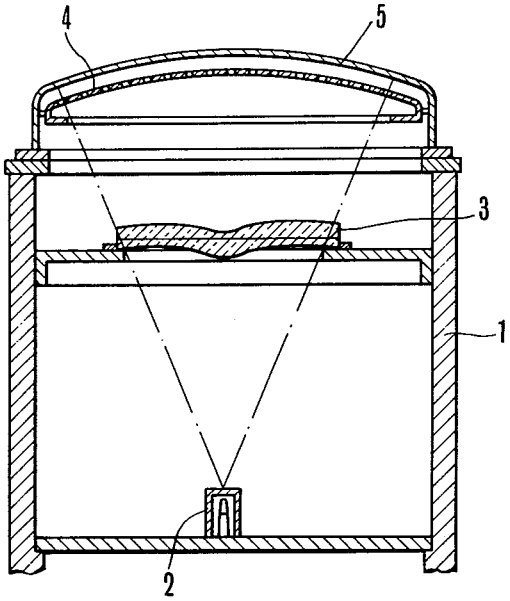
FIG. 1 shows a diagrammatic longitudinal section of a conventional exposure device utilized to prepare a fluorescent screen of a colour picture tube.

Such stripes of three colours can be prepared by applying photosensitive substance containing phosphors for three colours on the inner surface of the face plate of a colour picture tube and then exposing to light the photosensitive substances by utilizing an exposure device similar to that shown in FIG. 1. However, instead of utilizing a stationary point light source, the point light source is reciprocated in a manner to be described later.

The colour selecting member 10 is provided with a plurality of parallel stripe shaped perforations 8 extending in the same direction as the three colour phosphors 6a, 6b and 6c. These perforations have approximately the same vertical length as the three colour phosphors. To reinforce the colour selecting member, each stripe 8 is divided into a plurality of slit shaped sections by means of horizontal bridges 9.

Figure 2B:
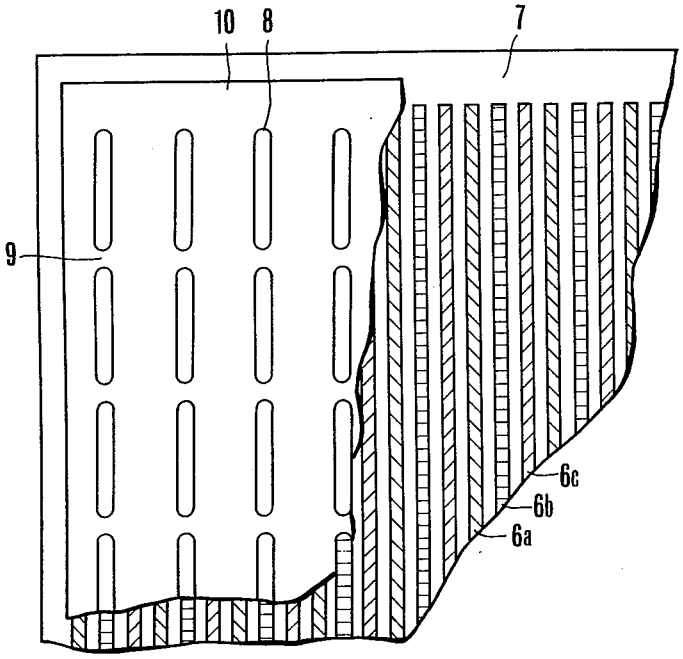
FIGS. 2B and 2C are views similar to FIG. 2A but showing different constructions of the fluorescent screen prepared by the method of this invention.
Figure 2C:
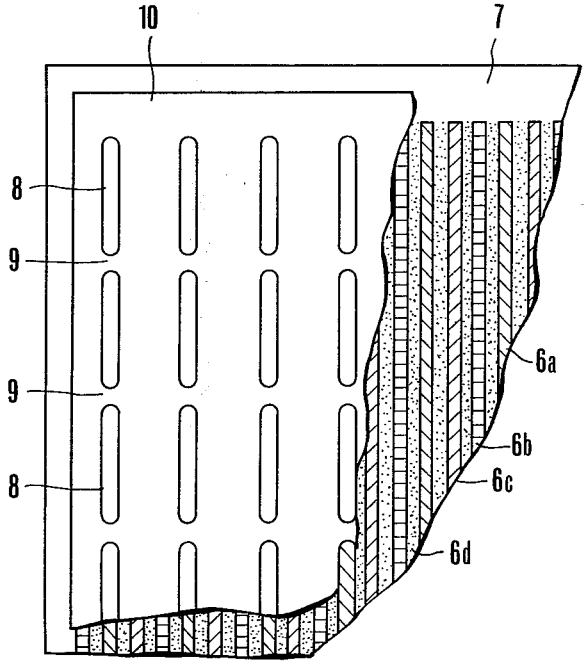

In the examples shown in FIGS. 2B and 2C stripe shaped three colour phosphors 6a, 6b and 6c are shaped apart from each other by a predetermined spacing in the horizontal direction. In the case of FIG. 2C, the regions between the stripe shaped three colour phosphors are coated with black non-luminous substance **6*d* such as graphite. In these figures, component parts identical to those shown in FIG. 2A** are designated by the same reference characters.

The fluorescent screen shown in FIG. 2C is manufactured in the following manner. A photoresist is applied onto the entire inner surface of the face plate of the colour picture tube and is then exposed to light through the stripe shaped perforations 8 of the colour selecting member 10. Then the not exposed portions of the photoresist are removed to form stripes of the photoresist corresponding to the stripe shaped three colour phosphors **6*a*, 6*b* and 6*c*. The black non-luminous substance 6d is applied onto the entire inner surface of the face plate and then the photoresist film is removed. Thereafter the stripe shaped three colour phosphors 6*a*, 6*b* and 6*c* are applied onto the portions of the face plate from which the photoresist has been removed thereby completing the fluorescent screen shown in FIG. 2C.**

The colour picture tubes manufactured as above described have the following advantages. More particularly, in the case of FIG. 2A, since the continuous stripe shaped trios of three colour phosphors **6*a*, 6*b* and 6*c*** are regularly formed in the direction of vertical deflection, in the actual use of the colour picture tube, it is not necessary to adjust the colour purity in the vertical direction whereby the adjusting means of the colour television receiving set can be simplified.

In the case shown in FIG. 2B, because the stripe shaped three colour phosphors **6*a*, 6*b* and 6*c* are spaced apart in the horizontal direction, in addition to the advantage just mentioned, the colour shading caused by improper adjustment of the electron beam, that is the tendency of the electron beam to impinge upon adjacent phosphor can be greatly reduced. In the construction shown in FIG. 2C, it is possible to obtain the merit of the so-called black matrix in addition to the advantages of the constructions shown in FIGS. 2A and 2B.** In other words, it is possible to improve contrast.

Figure 3:
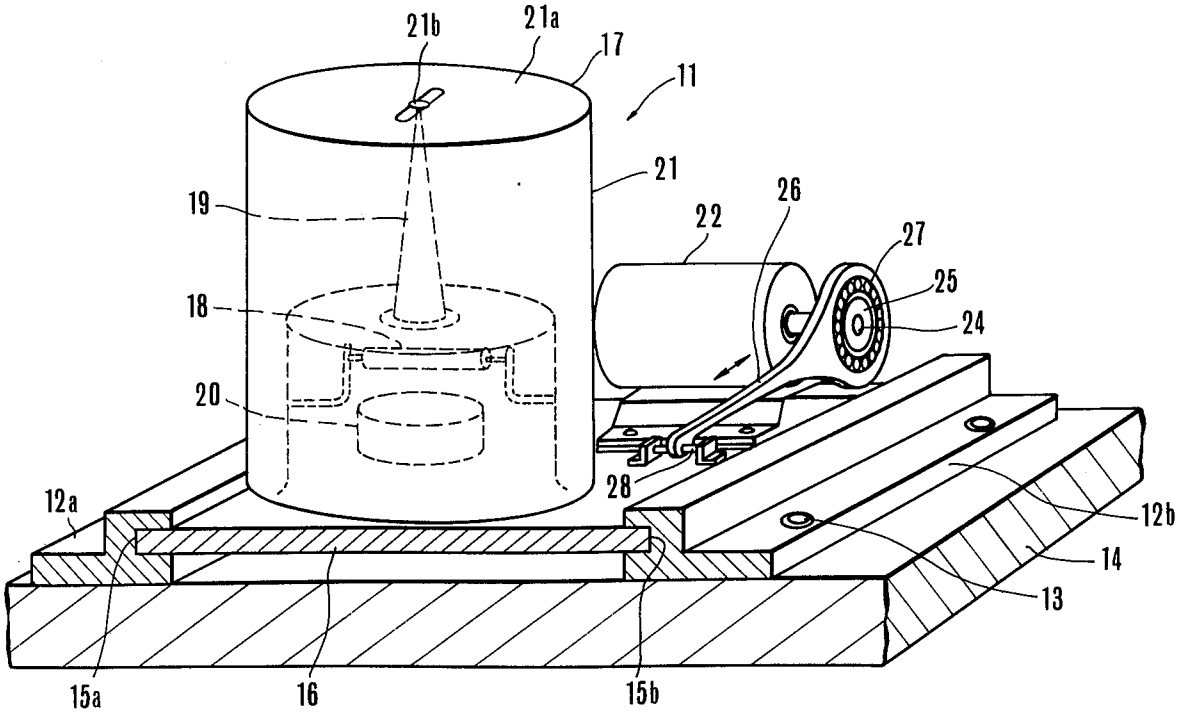
FIG. 3 shows a schematic perspective view of a light source utilized to carry out the method of this invention.

FIG. 3 shows one example of the method of moving the exposure light source utilized to carry out the method of this invention. The exposure light source 11 is to be disposed at the position of the point light source 2 of the exposure device 1 shown in FIG. 1. Parallel guide members **12*a* and 12*b* are secured to a stationary bed 14 by screws 13. The guide members 12*a* and 12*b* are formed with guide grooves 15*a* and 15*b* on their confronting side surfaces. A movable plate 16 supporting the point light source 17 is received in the guide grooves 15*a* and 15*b*. The point light source 17 may have the same construction as the prior art point light source. In the illustrated example, the point light source 17 comprises a tubular mercury arc lamp 18, a conical collimator 19 mounted above the mercury arc lamp 18 for collimating the light to the apex, a reflector 20 for reflecting downwardly radiated light toward the collimator 19 and a casing 21 enclosing the collimator, the mercury arc lamp and the reflector except the apex of the collimator. An electric motor 22 is mounted on the stationary bed 14 and a circular disc 25 is mounted on the shaft 24 of motor 22 with a small eccentricity. An operating arm 26 is provided with one end rotatably mounted on the circular disc 25 through a bearing 27, the other end of the operating arm 26 being pivotally connected to a pin 28 secured to the movable plate 16.**

When the motor 22 is energized, due to the small eccentricity of disc 25, the operating rod 26 mounted thereon is reciprocated as shown by a double headed arrow. Consequently, the movable plate 16 is reciprocated along guide grooves 15a and **15*b*. The light emitted by the mercury lamp 18 is reflected by reflector 20 and collimated to the apex of the collimator 19 to form a point light source at the apex. However, as the movable plate 16 is reciprocated with an amplitude of about 7 to 8 mm, the point light source 17 is also reciprocated with the same amplitude. Accordingly, the light source 17** operates as a linear source of light having a length of about 7 to 8 mm. The longitudinal direction of the linear source of light coincides with the longitudinal direction of the stripe shaped perforations of the colour selecting member.

Figure 4:
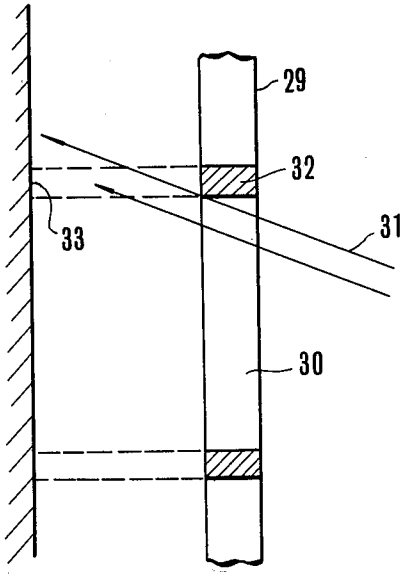
FIG. 4 is a diagram to show the relationship between the light and the colour selecting member when the light source shown in FIG. 3 is used.

In this manner, as shown in FIG. 4, by reciprocating a point light source to form a linear light source and by exposing the photosensitive substance to the light from this linear source of light and transmitting through the slit shaped sections of the colour selecting member 29 the light 31 will impinge obliquely upon the colour selecting member 29 so that the portions 33 of the fluorescent screen corresponding to bridges 32 will be irradiated by the oblique light. Consequently, it is possible to expose uniformly the entire vertical width of the fluorescent screen to form continuous stripe shaped three colour phosphors although the slit shaped sections 30 of the colour selecting member 29 is not continuous by the presence of the bridges 32.

In the above described embodiment, a point light source is reciprocated to cause it to act as a linear light source for exposing and forming continuous stripe shaped three colour phosphors. This is to make uniform the intensity of light at any portion of the linear light source. However, it is also possible to project the light from a stationary linear source of light through a stationary slit having a width of 2 mm and a length of 10 mm, for example. Of course, in this case it is not necessary to use the collimator.

Figure 5:
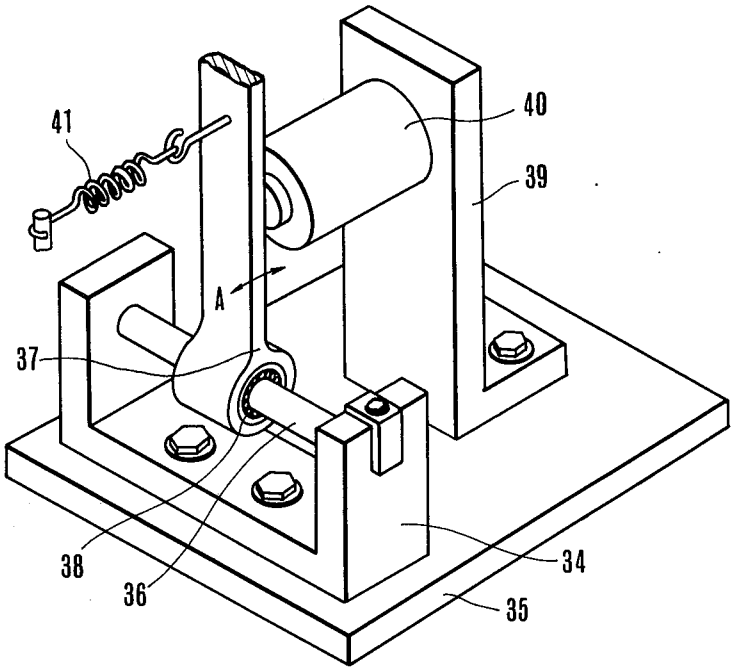
FIG. 5 is a schematic perspective view of a modified light source utilized to carry out the method of this invention.

FIG. 5 shows another method of moving an exposure light source utilized in this invention. The apparatus shown in FIG. 5 comprises a U shaped supporting frame 34 secured to a stationary base 35 by means of screws. A shaft 36 is secured to two legs of the supporting frame 34 and an operating arm 37 is rotatably mounted on shaft 36 through a bearing 38. A point light source (not shown) similar to that described above is mounted on the upper end of the operating arm 37. An electromagnet 40 with a core disposed to attract the operating arm 37 is secured to the upper end of an L shaped support 39 which is fastened to the stationary base 35. The operating arm 37 is biased to move away from the electromagnet 40 by means of a spring 41.

When the electromagnet 40 is energized by alternating current or a pulse signal of low frequency, the operating arm 37 will be vibrated in the direction of arrow A to reciprocate the point light source with an amplitude of about 7 to 8 mm thereby causing it to act as a linear light source. When the fluorescent screen is exposed with this apparatus continuous stripe shaped portions thereof are exposed over the entire range of vertical deflection. Thereafter, the continuous stripe shaped three colour phosphors are formed in the manner well known in the art.

It should be understood that the point light source is not limited to the above described type which comprises a mercury arc lamp and a collimator, and that it is possible to reciprocate the point light source by other mechanism than those described above.

As above described since according to this invention, the photosensitive substance of the fluorescent screen is exposed to light by reciprocating a point light source in a predetermined direction, the exposure light transmits obliquely through the stripe shaped perforations divided into slit shaped sections of the colour selecting member. For this reason, notwithstanding the provision of horizontal bridges which divide the stripe shaped perforations into a plurality of slit shaped sections it is possible to form stripe shaped trios of three colour phosphors which are continuous over the entire range of vertical deflection. It should be noted that these stripe shaped phosphors can also be formed in the direction of horizontal deflection.

What is claimed is:

1. A method of manufacturing a fluorescent screen for use in a colour picture tube wherein photosensitive substances coated on the inner surface of the panel of the tube are exposed to light emanated from a source of light through a plurality of parallel stripe shaped perforations of a colour selecting member each of which is divided into a plurality of slit shaped sections by means of bridges extending at substantially right angles with respect to the longitudinal direction of said perforation thereby forming a fluorescent screen including a plurality of parallel stripes of three colour phosphors, said perforations extending over substantially the entire length of one side of said colour selecting member, improvement in which said fluorescent screen is formed by projecting the exposure light emanated from a linear light source upon said photosensitive substances through said divided slit shaped sections, said linear light source being positioned parallel to said perforations and having an effective length sufficient to expose continuous stripes corresponding to said perforations on said photosensitive substances including the regions behind said bridges.

2. The method according to claim 1 wherein said linear light source is constituted by reciprocating a point source in a direction parallel to said stripe shaped perforations.

3. The method according to claim 1 wherein said light source comprises a stationary elongated tubular lamp disposed in parallel with said stripe shaped perforations.

* * * * *

Notice of Adverse Decision in Interference

In Interference No. 99,328, involving Patent No. 3,936,302, Y. Takami, K. Fukuda and E. Yamazaki, METHOD FOR MANUFACTURING FLUORESCENT SCREENS FOR USE IN COLOUR PICTURE TUBES, final judgment adverse to the patentees was rendered Dec. 15, 1976, as to claims 1 and 3.

[*Official Gazette March 22, 1977.*]